US009067757B2

(12) United States Patent
Bour et al.

(10) Patent No.: US 9,067,757 B2
(45) Date of Patent: Jun. 30, 2015

(54) METHOD AND REEL DEVICE FOR THREADING TENDONS INTO DUCTS

(75) Inventors: Denys Bour, Asnieres-sur-Seine (FR); Jean-Baptiste Domage, Marly le Roi (FR); Jean Marie Laurens, Lausanne (CH)

(73) Assignee: VSL INTERNATIONAL AG, Koniz (CH)

( * ) Notice: Subject to any disclaimer, the term of this patent is extended or adjusted under 35 U.S.C. 154(b) by 354 days.

(21) Appl. No.: 13/623,361

(22) PCT Filed: Apr. 28, 2010

(86) PCT No.: PCT/EP2010/055736

§ 371 (c)(1),
(2), (4) Date: Dec. 28, 2012

(87) PCT Pub. No.: WO2011/134510

PCT Pub. Date: Nov. 3, 2011

(65) Prior Publication Data

US 2013/0180095 A1 Jul. 18, 2013

(51) Int. Cl.

| | |
|---|---|
| ***E04C 5/08*** | (2006.01) |
| ***E04C 5/10*** | (2006.01) |
| ***E04H 7/20*** | (2006.01) |
| ***B65H 54/02*** | (2006.01) |
| ***E04G 21/12*** | (2006.01) |

(52) U.S. Cl.

CPC ..... *B65H 54/02* (2013.01); *Y10T 29/49874* (2015.01); *E04C 5/10* (2013.01); *E04G 21/12* (2013.01)

(58) Field of Classification Search

CPC ..... E04C 5/08; E04C 5/10; E04G 21/12; E04G 21/125; E04G 21/126; E04G 2021/127; E04H 7/20; E04H 7/26; F16G 11/00; G21C 13/0933; Y10T 29/49874; Y10T 29/49732; Y10T 29/49616; B65H 54/02; B65H 75/26

See application file for complete search history.

(56) References Cited

U.S. PATENT DOCUMENTS

| | | | | |
|---|---|---|---|---|
| 3,719,982 | A * | 3/1973 | Tindal | 29/452 |
| 4,095,326 | A * | 6/1978 | Harvey | 29/417 |
| 4,265,066 | A * | 5/1981 | Lin et al. | 52/223.2 |
| 4,463,872 | A * | 8/1984 | Yellowlees | 220/592 |
| 8,650,691 | B2 * | 2/2014 | Collin Delavaud et al. | 14/22 |
| 2009/0025307 | A1 * | 1/2009 | Crichlow | 52/81.1 |

FOREIGN PATENT DOCUMENTS

| | | |
|---|---|---|
| DE | 3708358 A1 | 9/1988 |
| EP | 0558988 A1 | 9/1993 |

OTHER PUBLICATIONS

International Search Report Issued Feb. 16, 2011 in PCT Application No. PCT/EP2010/055736.

* cited by examiner

*Primary Examiner* — Alexander P Taousakis
(74) *Attorney, Agent, or Firm* — Pearne & Gordon LLP

(57) ABSTRACT

A method is described for threading a tendon into a duct from an opening at an intermediate point along the length of the duct. Opposite ends of the tendon are threaded from a reel into the two halves of the duct. The tendon is wound on to the reel such that both ends of the tendon can be unwound into the duct simultaneously. A reel and a method for winding the tendon on to the reel are also claimed. The method and reel are particularly suitable for threading coated steel tendons into PT ducts in tall structures such as containment vessels.

12 Claims, 10 Drawing Sheets

METHOD AND REEL DEVICE FOR THREADING TENDONS INTO DUCTS

The present invention relates to the field of threading flexible filaments into tubes. In particular, but not exclusively, it relates to the field of threading post-tensioning (PT) tendons into PT ducts in cast concrete structures.

Post-tensioning is a well-established technique for reinforcing cast concrete structures. Ducts are positioned within the volume to be cast, and PT tendons are fed through the ducts where they remain in their untensioned state until the concrete is sufficiently cured for the tensioning to take place. The tensioning operation is usually performed using hydraulic jacks at one or both ends of the tendon. The tendons are stressed to a specified tension, whereupon the jacked ends are anchored, using special anchors, in the concrete.

A post-tensioning tendon may typically consist of a bundle of steel strands. Tendons are commonly inserted strand by strand, however some geometries require the whole bundle to be threaded through the duct in one operation. One such case is the construction of containment vessels, or any large structure in which continuous PT tendons are required to be routed from the bottom of one side of a vessel, up over the top of the vessel and down to the bottom of the other side. An example might be the reactor vessel of a nuclear power station. In such cases, the tendons are threaded from the bottom of one side, travelling over the top of the vessel, until they reach the bottom of the other side. It is not normally possible to push strands individually, since the threading of the later strands would be obstructed by the already-threaded strands. For this reason, the bundle of strands is pushed and/or pulled through in one operation. This can be achieved by means of a pulling cable previously threaded through the duct, which is attached to the inserted end of the tendon in the near end of the duct, and to a winch at the remote end of the duct. The winch then pulls the tendon through the duct. Friction with the duct walls can be further reduced be other means, including lubrication or mechanical means such as rollers. However, the duct will normally subsequently be filled with a filler, such as a grout or a grease, in order to help protect the tendons against corrosion; such lubricants and mechanical means can interfere with the effectiveness of certain fillers.

Some projects require the strands to be coated, for example in polymeric material. However, such material is relatively easy to damage, and is not capable of withstanding the process of being pulled through the duct described above.

European patent application EP0558988 describes the problems associated with threading coated tendons through PT ducts, and proposes a tendon-pushing machine which maintains a steady force on the tendon while providing a braking action which prevents the elasticity of the tendon from suddenly pulling the tendon into the duct.

German patent application DE3708358 describes a method of reducing the friction when threading PT tendons, for example in containment vessels. The proposed solution in DE3708358 is the provision of intermediate openings along the length of the duct, each with an intermediate pusher unit to provide additional pushing force to compensate for the losses due to friction between the tendons and the duct walls.

No satisfactory tendon-threading method has been proposed in the prior art which would enable a bundle of coated strands to be threaded together through a long duct, especially if the duct includes one or more bends, without damaging the tendon in the process.

The object of the present invention is to overcome these and other disadvantages of the prior art methods.

To this end, the present invention envisages a method of threading a tendon into a duct, the tendon having an intermediate tendon length portion at a predetermined intermediate location along the length of the tendon between the first and second ends of the tendon, the tendon thereby comprising a first tendon length portion, being the portion of the tendon between the intermediate tendon length portion and the first end of the tendon, and a second tendon length portion, being the portion of the tendon between the intermediate tendon length portion and the second end of the tendon, the duct having an intermediate duct length portion at a predetermined intermediate location along the length of the duct between the first and second ends of the duct, the duct thereby comprising a first duct length portion, being the portion of the duct between the intermediate duct length portion and the first end of the duct, and a second length portion, being the portion of the duct between the intermediate duct length portion and the second end of the duct, the method including a first step of providing the duct with an opening in the intermediate duct length portion, a second step of feeding the first tendon length portion through the opening into the first duct length portion, and a third step of feeding the second tendon length portion through the opening into the second duct length portion. By feeding the tendon from an intermediate point along the length of the duct, the effective distance through which each tendon portion must be pushed is greatly reduced, consequently with an even greater reduction in the friction between the tendon and the duct walls. This is particularly advantageous when the tendon is to be threaded through a duct which runs up one side of a structure and down the other: when such a tendon is pulled up a first side, over the top region and down the second side of such a duct, there is a very great friction on the part of the tendon being pulled over the top of the structure, due to the weight of the tendon being pulled up the first side. The downward force required to pull the tendon through the duct is magnified significantly because of this large frictional force on the tendon. By inserting the tendon at a midpoint along the duct, the friction between the tendon and the duct can be greatly reduced, and the mutual inflation of forces described above can be reduced or eliminated. The high frictional forces in the prior art methods create a high risk of damaging any protective coating or sheath on the strands and/or the bundle. By reducing these frictional forces, the method of the invention therefore substantially reduces this risk.

As described above, the tendon being threaded through the duct can be a PT tendon comprising multiple strands.

According to one embodiment of the method of the invention, the second and third steps are performed at least partially simultaneously. The two length portions of the tendon can thereby be uncoiled from the reel and into the opening in the duct at the same time, thus reducing the time required for the threading operation, while also keeping the forces on the two tendon length portions approximately balanced, thus reducing the net pushing or pulling force required.

The method of the invention (second and/or third steps) may include pushing the tendon into the duct. The method may be used for threading tendons through a duct arranged in a substantially vertical cast structure, such that the duct has a first lower end, a second lower end and an upper region between the first and second lower ends, and in which the opening is situated in the upper region of the duct. By threading the tendon through an opening in the upper part of the duct (for example at the top), the tendon can, for at least part of the insertion procedure, be drawn into the duct by the gravitational force on that part of the tendon already fed into the duct. In this case the method has the additional advantages of a)

reduced friction due to the tendon being pulled by gravity rather than being pushed into the duct, and b) potentially obviating the need for pre-threading a pulling cable.

According to another embodiment of the invention, the method comprises a fourth step, performed before the second and third steps, comprising winding the tendon on to a reel, the winding starting at the intermediate tendon length portion such that the first and second tendon length portions are wound on to the reel simultaneously. The two portions of the tendon can then subsequently be unwound from the reel into their respective duct length portions through the opening in the duct.

The invention also envisages a reel for pre-coiling a tendon prior to threading the tendon into a duct, the tendon having a winding start portion at a predetermined intermediate location along the length of the tendon between the first and second ends of the tendon, the tendon thereby comprising a first length portion, being the portion of the tendon between the winding start portion and the first end of the tendon, and a second length portion, being the portion of the tendon between the winding start portion and the second end of the tendon, the tendon having a predetermined minimum radius of bending, hereafter referred to the bending limit, the reel having tendon holding means for holding the winding start portion of the tendon such that, when the tendon is wound on to the reel, the winding starts at the winding start portion of the tendon, first winding spool for winding on the first length portion of the tendon, and second winding spool for winding on the second length portion of the tendon. By pre-coiling the tendon on to the reel (which can be carried out at a site remote from the site where the tendon is to be installed), significant construction time can be saved.

The first and second winding spools may be separate, or they may be the same spool.

The tendon holding means may comprise a looping element for doubling the tendon back on itself around a curved path, the curved path having a radius of curvature at least as great as the minimum bending radius of the tendon.

The invention also envisages a method of winding a tendon on to a reel such as the reel described above, the method comprising a first step of arranging the tendon in position such that the winding start portion of the tendon engages with the tendon holding means of the reel, a second step of winding the first length portion of the tendon on to the first spool, and a third step of winding the second length portion of the tendon on to the second spool. The first and second steps can be performed simultaneously.

In this way, both ends of the tendon can subsequently be unwound from the spool(s) and into the duct opening simultaneously.

According to a variant of this method of the invention, in which the tendon comprises a plurality of strands, the first step includes arranging each of the strands such that a winding start portion of each strand engages with the tendon holding means of the reel. The strands can thus be assembled into the tendon bundle as part of the same operation as the winding of the tendon on to the reel.

According to another variant of the invention, the spool(s) can be mounted such that, during the winding operation, the or each spool can be moved along its axis of rotation in such a way as to control the distribution of tendon coils along the said axis of rotation.

The invention will now be described in more detail and with reference to the attached drawings, in which FIG. 1 shows an example tendon geometry for which the methods and reel of the invention can be used.

FIGS. 5*a* to 9*b* show steps in winding a tendon on to the reel.

FIGS. 10*a* to 10*d* show steps in unwinding a tendon off the reel.

It should be noted that the figures are provided for illustrative purposes and to aid an understanding of the invention. They do not imply any limitation of the scope of protection of the invention, which is set out in the appended claims.

Figure 1:
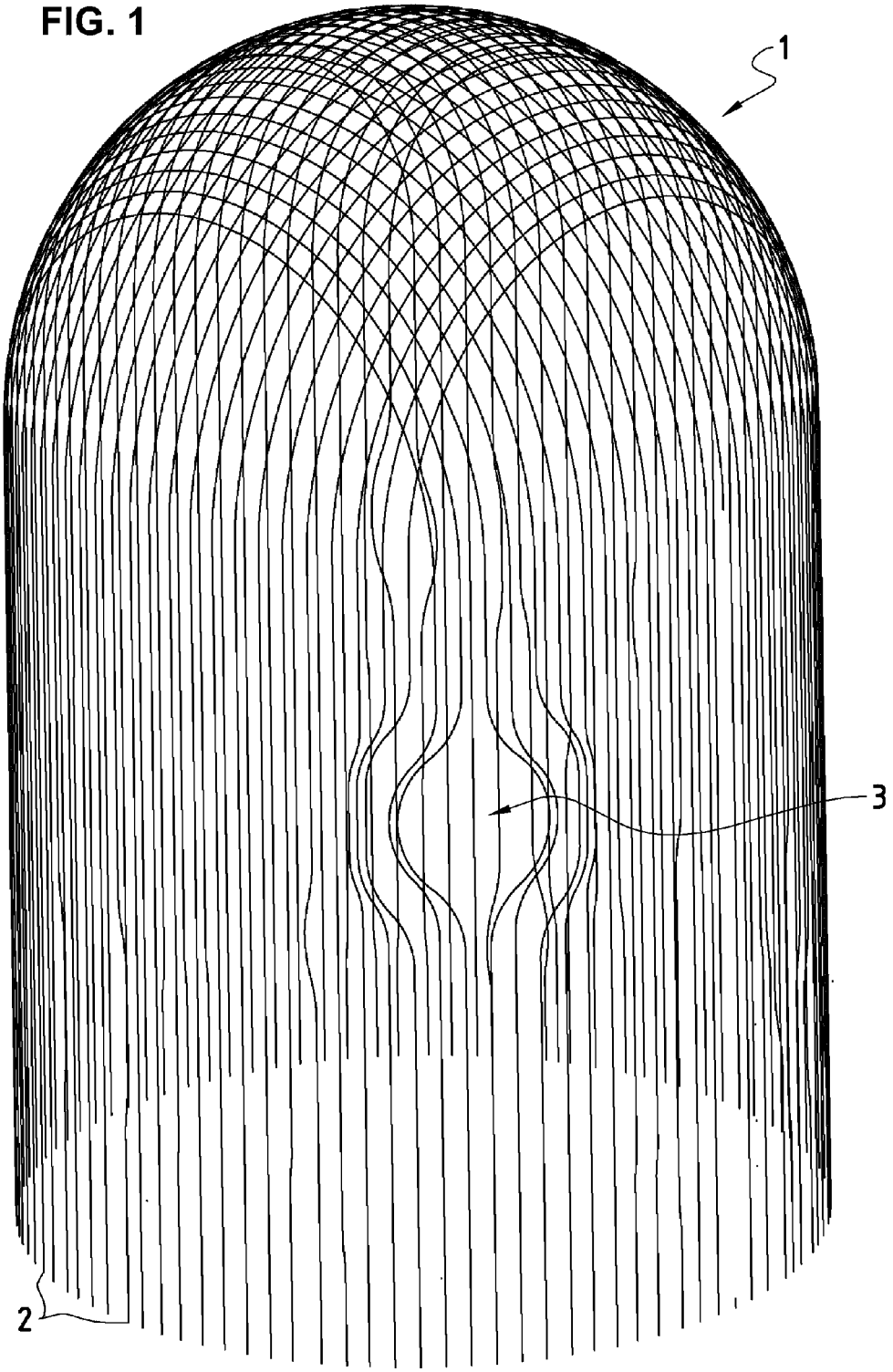

FIG. 1 shows in schematic form an example of a tendon geometry for casting an above-ground containment vessel, such as for a fluid tank or a nuclear reactor. In the latter case, the structure may be as much as 80 m high and 40 m or 50 m in diameter. As can be seen from FIG. 1, the structure 1 is reinforced by means of many tendons 2, each running from the bottom of the structure, over the top of the structure and down the other side. Two sets of tendons 2 are shown, arranged orthogonal to each other. In the case of a nuclear containment vessel, each tendon may be 150 m or more in length. In the example shown in FIG. 1, some of the tendons are routed around an opening 3 in the structure. Note that the ducting is not shown in FIG. 1. There may be any number of strands in the bundle making up each tendon; 55 is a common number. However, a tendon can consist of any number of strands, or only one strand. A strand may in turn comprise multiple (for example 7) high-tensile wires twisted together, or it may comprise just one wire. The strands may be bare and/or individually galvanised and/or coated with grease encapsulated in polymeric material such as polyethylene (PE) to protect the steel from corrosion.

Figure 2:
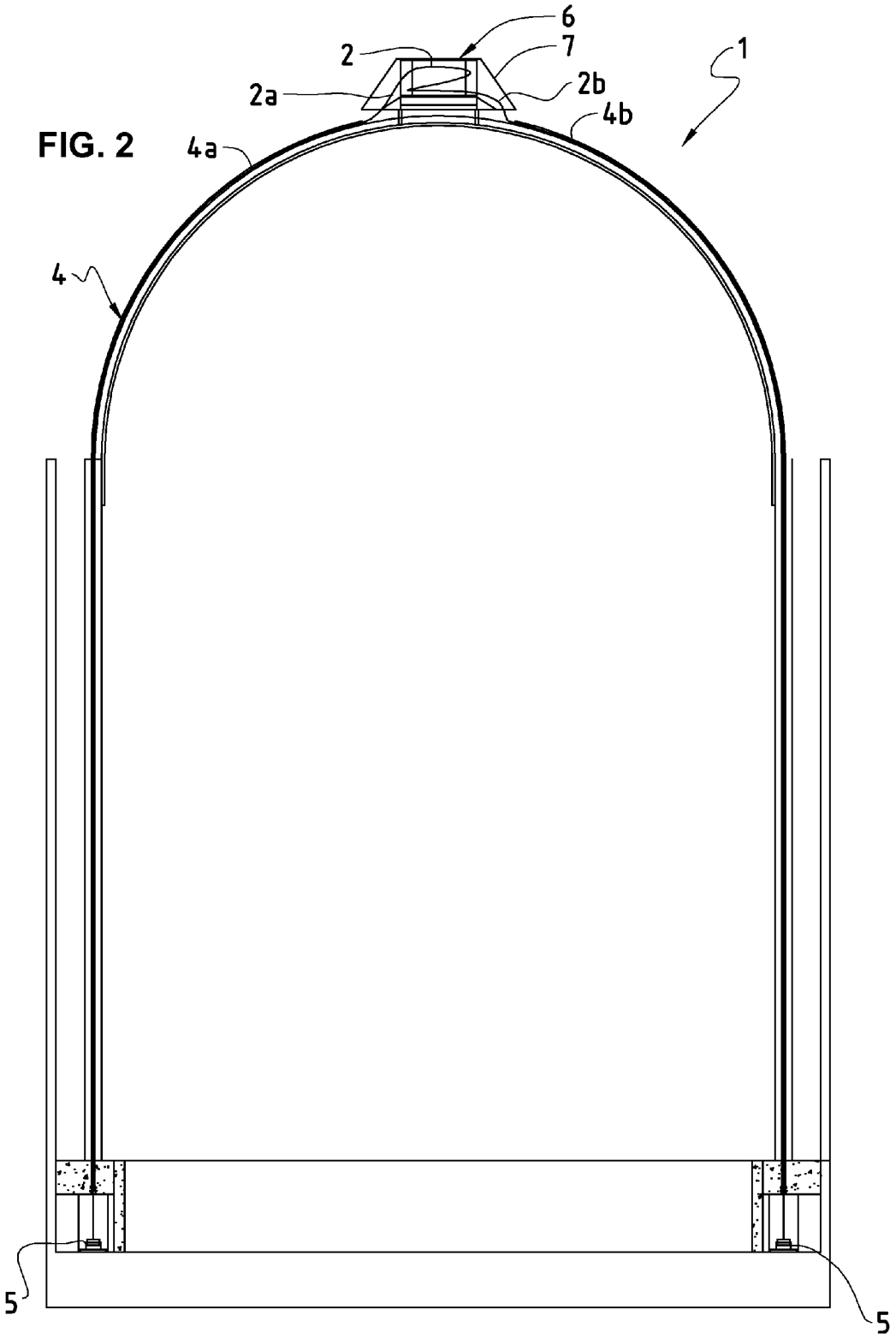
FIGS. 2 and 3 show example implementations of a method of the invention.
Figure 3:
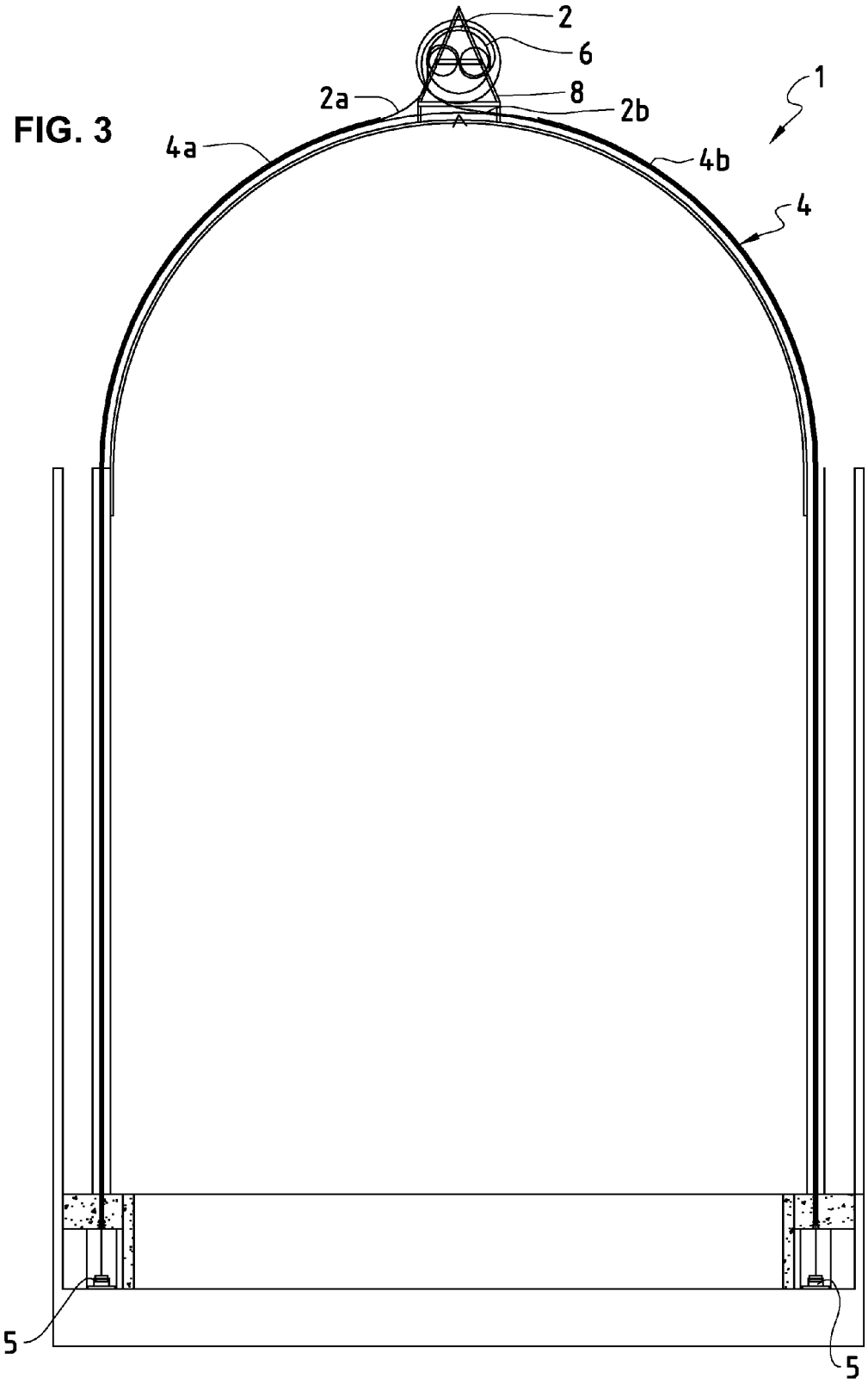

FIGS. 2 and 3 show how the method of the invention may be used to thread a tendon into a duct in a geometry such as the one shown in FIG. 1. A structure 1 is shown in schematic cross-section, with a duct 4 having length portions 4*a* and 4*b* either side of an opening at the top, through which tendon length portions 2*a* and 2*b* are being threaded respectively. Tendon 2 is shown being unwound off a reel 6, with both portions 2*a* and 2*b* being unwound simultaneously. The reel 6 on which the tendon 2 is stored can be raised into position by a crane, for example (not shown), and the empty reel 6 can then be removed and re-used once the tendon 2 has been wound off the reel 6 and into the duct 4. In FIG. 2, the reel 6 is shown with its rotational axis vertical, covered by a protective cowl 7, while in FIG. 3 the reel 6 is shown with its rotational axis horizontal, mounted in a frame 8. In both cases, the tendon can be assembled and wound on to the reel at a site remote from the site where structure 1 is being constructed. The pre-assembly and pre-winding of the tendon 2 on to the reel 6 greatly reduces the amount of time required to thread the tendon 2 into the duct 4. The threading of both halves 2*a* and 2*b* of the tendon 2 at once reduces the threading time still further. The tendon portions 2*a* and 2*b* can be pushed into duct portions 4*a* and 4*b* respectively. If necessary, winches 5 can be used to pull the tendon portions 2*a*, 2*b* down through the duct 4, for example using pre-threaded pulling wires.

Figure 4:
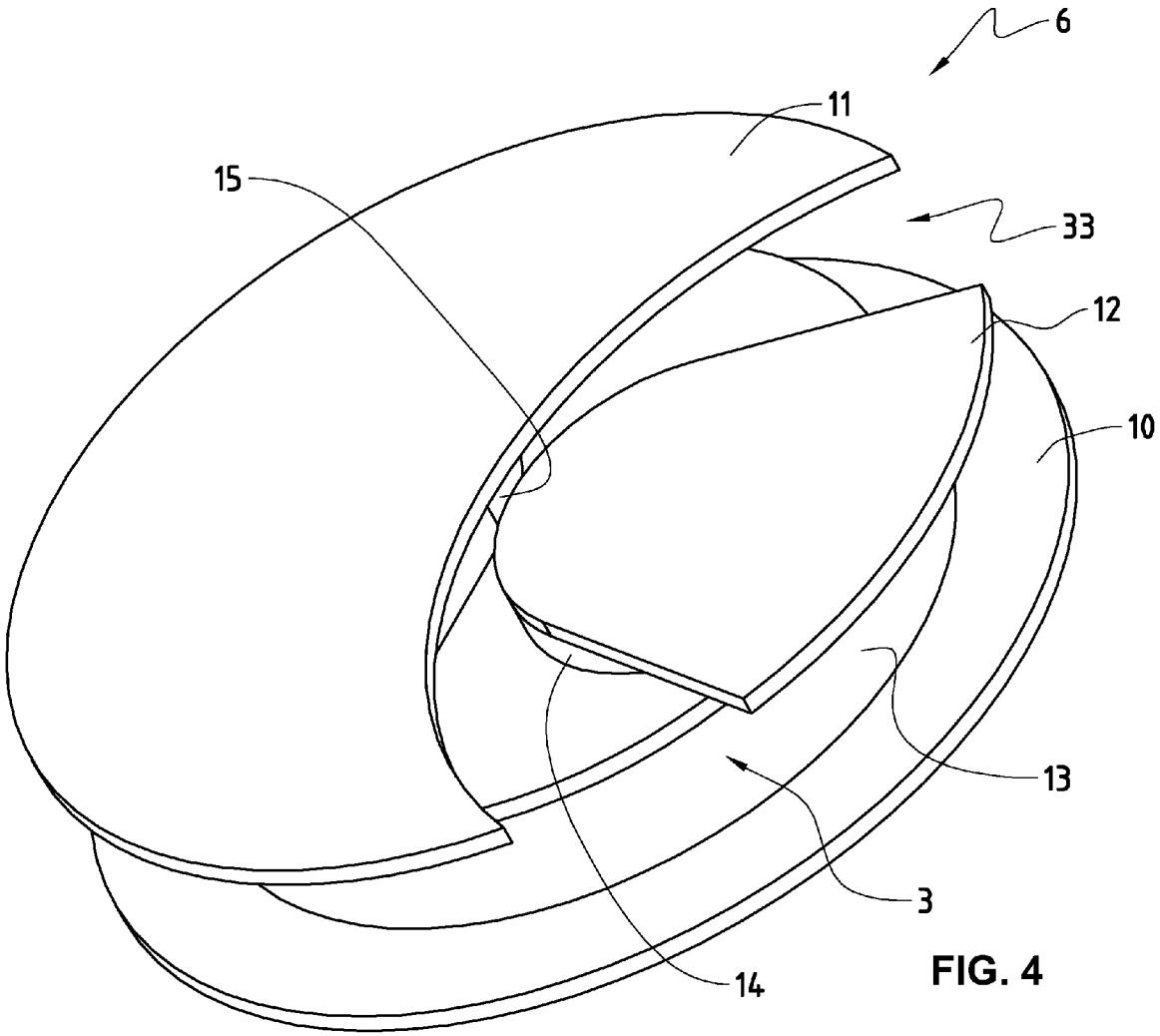
FIG. 4 shows an example reel according to the invention.

FIG. 4 shows an example of a reel 6 which can be used to wind on and store the tendon 2. The reel 6 shown in FIG. 4 comprises a spool 13 around which the tendon 2 is to be wound. Loop retaining element 14 is for looping a mid-point of the tendon around, so that then both halves of the tendon are wound on to the spool 13 when the reel 6 is rotated. Curved surface 15, together with the curved surface of loop retaining element 14, ensure that the tendon 2 is not bent through a predetermined minimum bending radius during the winding operation, thereby avoiding mechanical damage to the tendon which could occur if the tendon were to be excessively bent. Side elements 10, 11 and 12 serve to keep the tendon 2 on the spool 13 during winding and storage of the tendon 2. The gap 33 between side elements 11 and 12 allows the tendon strands to be positioned ready for winding, and the gap 33 also allows the mid-point of the tendon to be unhooked from the reel once the length portions have been unwound from the reel, in order that the empty reel 6 may be removed.

The reel 6 illustrated in FIG. 4 is designed to enable both halves of the tendon to be wound on to the same spool 13. This is however just one example of a reel which could be used to implement the invention. An alternative reel 6 could for example comprise two spools 13, one for each tendon length portion. The two spools could be mechanically linked, or not, and the two spools could rotate in the same or opposite rotational directions, as required.

Note that when reference is made to "halves" or "mid-point" of tendon 2 or duct 4, this should not be taken to imply that the length portions 2*a* and 2*b*, or 4*a* and 4*b* are necessarily equal in length. It is quite possible for the method to be used in situations where the length portions 2*a* and 2*b* or 4*a* and 4*b* are significantly different in length.

The method of loading the tendon 2 on to the reel 6 will now be described with reference to FIGS. 5*a* to 9*b*.

Figure 5A:
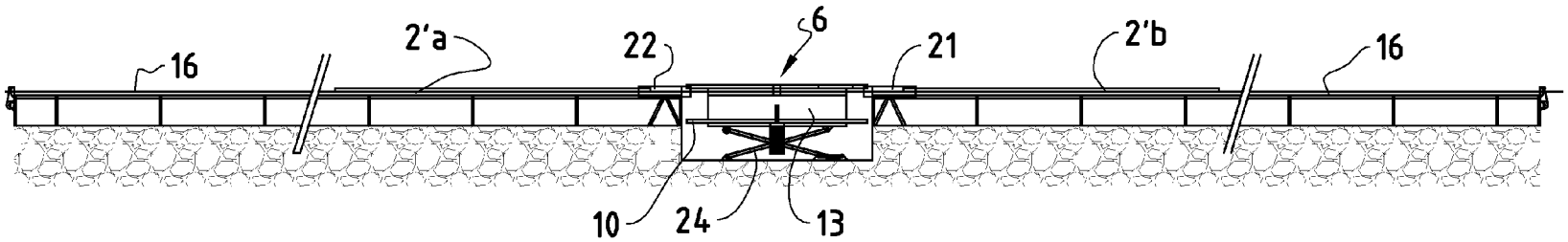
Figure 5B:
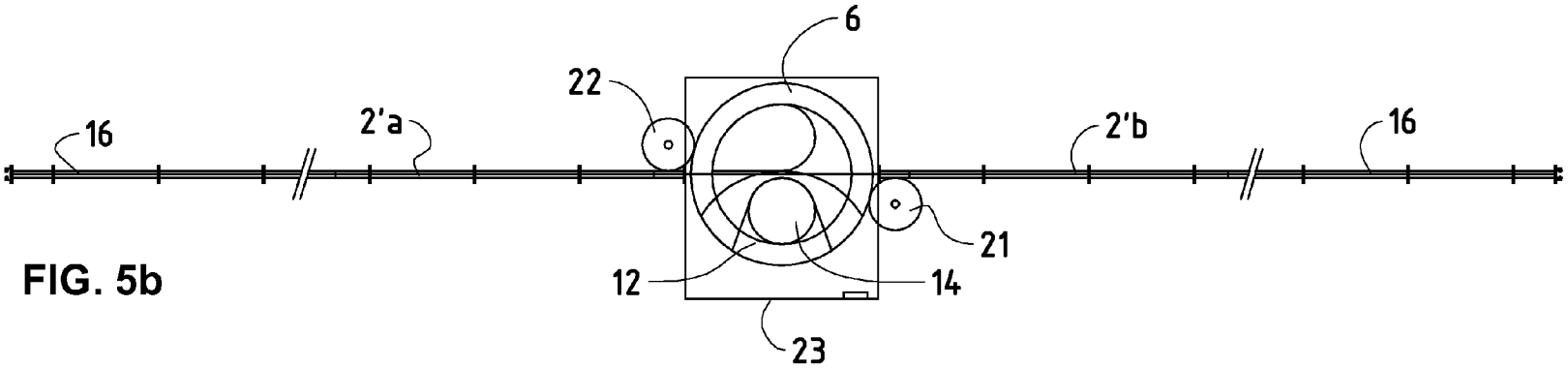

FIGS. 5*a* and 5*b* show in elevation and plan view respectively an example of a setup jig for assembling the strands 2' which make up the tendon 2, and for then winding the tendon 2 on to the reel 6. In the example shown, the reel 6 is mounted with its axis of rotation vertical, although it could also be mounted with its axis of rotation at any angle. Reel 6 is mounted on height adjuster 24, which supports the reel 6 during the assembly of the tendon, and can then be used to adjust the height of the reel 6 during the winding process, thereby controlling the distribution of the tendon 2 on the spool 13. Strand 2'*a* and 2'*b* are shown arranged on tendon support 16, which is designed to support the strands as they are assembled together and then wound on to the reel 6. Guide means 21, 22 are provided for guiding the tendon 2 on to the reel during winding, such that the length portions 2*a* and 2*b* of tendon 2 are drawn straight towards the reel 6 along the strand support 16 when the reel 6 is turned.

Note that this is just one possible arrangement for laying out the tendon 2 for winding. It could be laid out with both length portions 2*a* and 2*b* lying side by side, doubled back by looping the strands around the loop retaining element at their midpoints instead of laying them out straight as shown in FIGS. 5*a* and 5*b*. If the strands are assembled doubled back in this fashion, then the land area required for the set-up jig assembly is greatly reduced. In the case of long tendon of 150 m or more, this area saving is considerable.

Figure 6A:
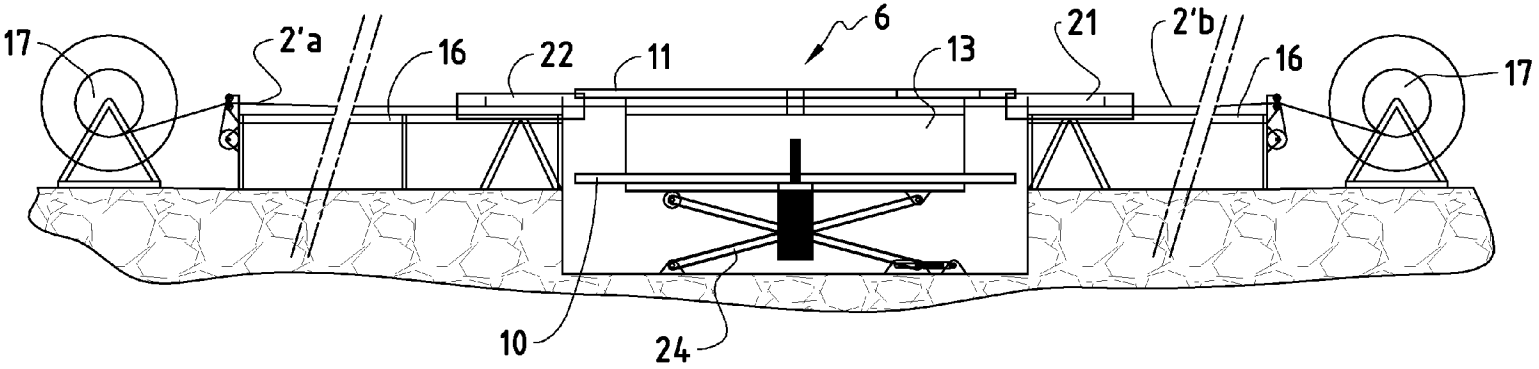
Figure 6B:
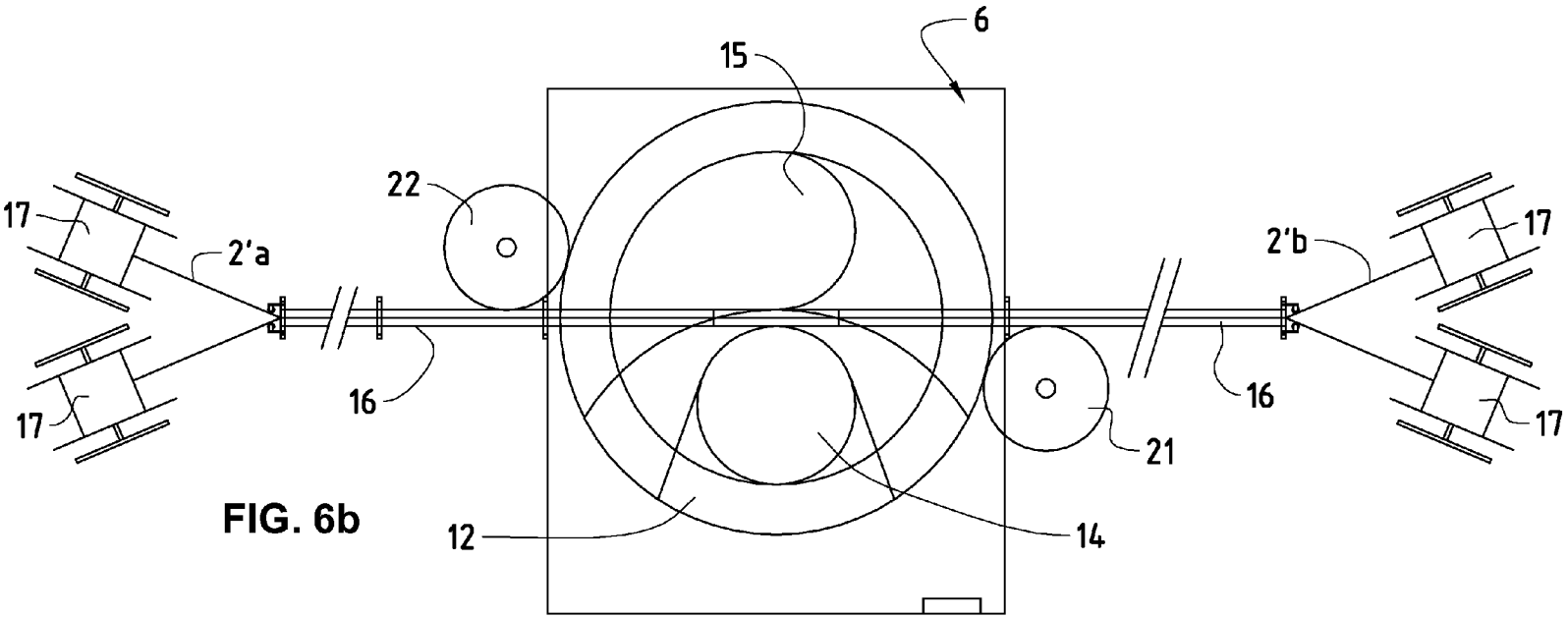

FIGS. 6*a* and 6*b* show in side elevation and plan view respectively greater detail of the setup jib illustrated in FIGS. 5*a* and 5*b*. Strand reels 17 supply the strands which are then cut to length and assembled before being wound together as tendon 2 on to reel 6. The strand support 16 is arranged so that all the strands can be laid out straight, with their mid-points in position in the reel 6, ready to start winding on to the spool 13.

The tendon assembly and winding operations can be carried out at a location away from the main construction site, and at a time which does not affect the construction schedules. The strands may be laid out individually on the strand support 16 so as to form tendon comprising a simple bundle of individual strands. The strands may be arranged such that the cross-section of the tendon has a predetermined pattern and/or outline. This can be achieved, for example, by using suitable fastening jigs or outline templates. Different installations may require different tendon cross-sections, and the tendon assembly step provides an opportunity to shape the tendon cross-section as required. For example, it is possible to assemble the strands in bundle having a semi-circular cross-section (advantageously enclosed in a suitably shaped semi-circular sheath). Such a pre-shaped tendon is then wound on to the reel, the tendon retaining its cross-section profile, and subsequently unwound into the duct with the tendon cross-section already oriented for optimum tensioning. If the strands are all pre-assembled in such a pattern, then the strands will undergo minimal lateral movement and consequently minimal friction against each other during tensioning, thereby further reducing the likelihood of damage to the strands or their coatings.

Alternatively, the strands can be grouped into multiple sub-bundles, with each sub-bundle being separately packed and/or wrapped or sheathed. The strands or sub-bundles can be arranged parallel to each other, or they can be twisted together during and/or after the laying-out process.

Figure 7A:
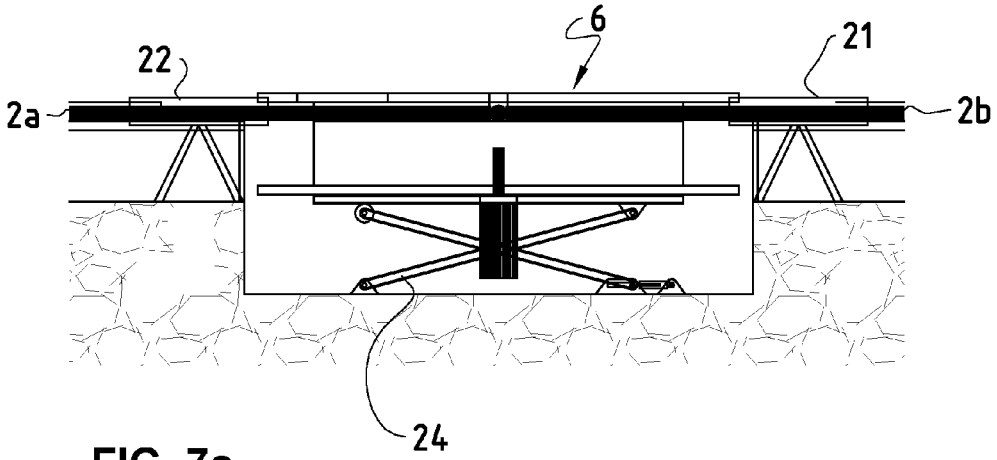
Figure 7B:
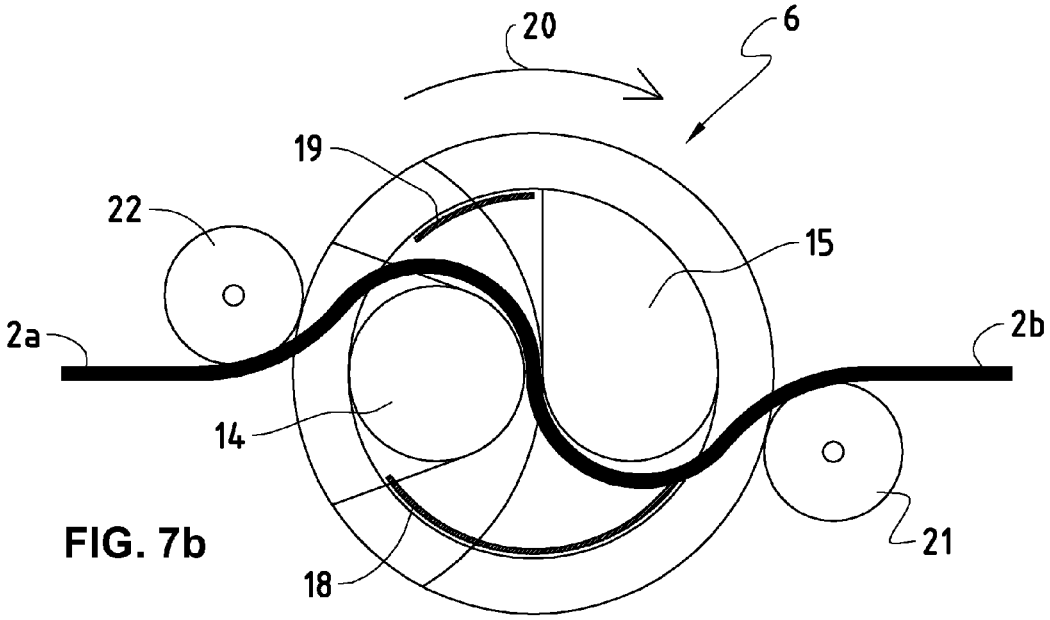

FIGS. 7*a* and 7*b* show the beginning of the winding operation. Once the strands 2' have been assembled to make up tendon 2, the reel 6 is rotated in the direction indicated by arrow 20, and the tendon 2 is held in place against the curved faces of loop retaining elements 14 and 15. Again, guides 21 and 22 ensure that the tendon is drawn evenly on to the reel 6. Height adjusting means 24 is in its low position in FIG. 7*a*, with the tendon aligned with the curved surfaces of the loop retaining elements 14 and 15.

Figure 8A:
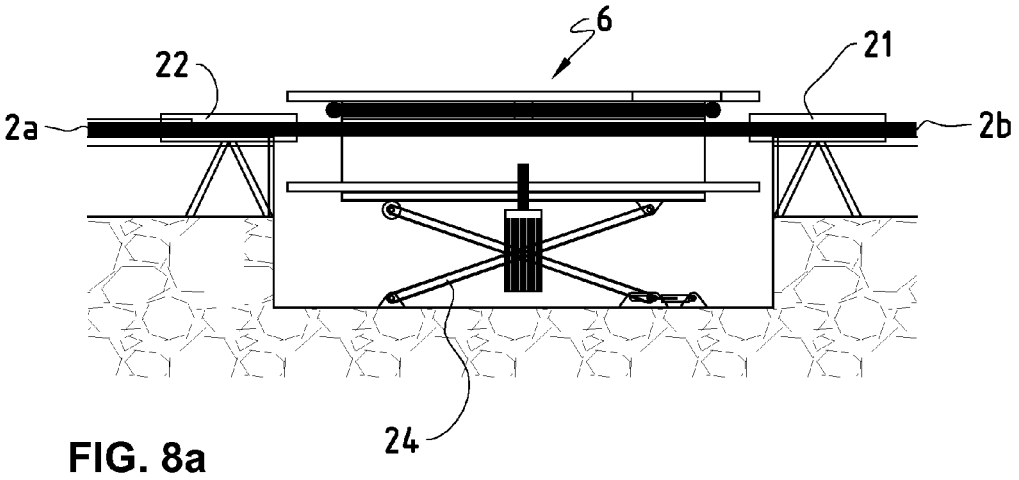
Figure 8B:
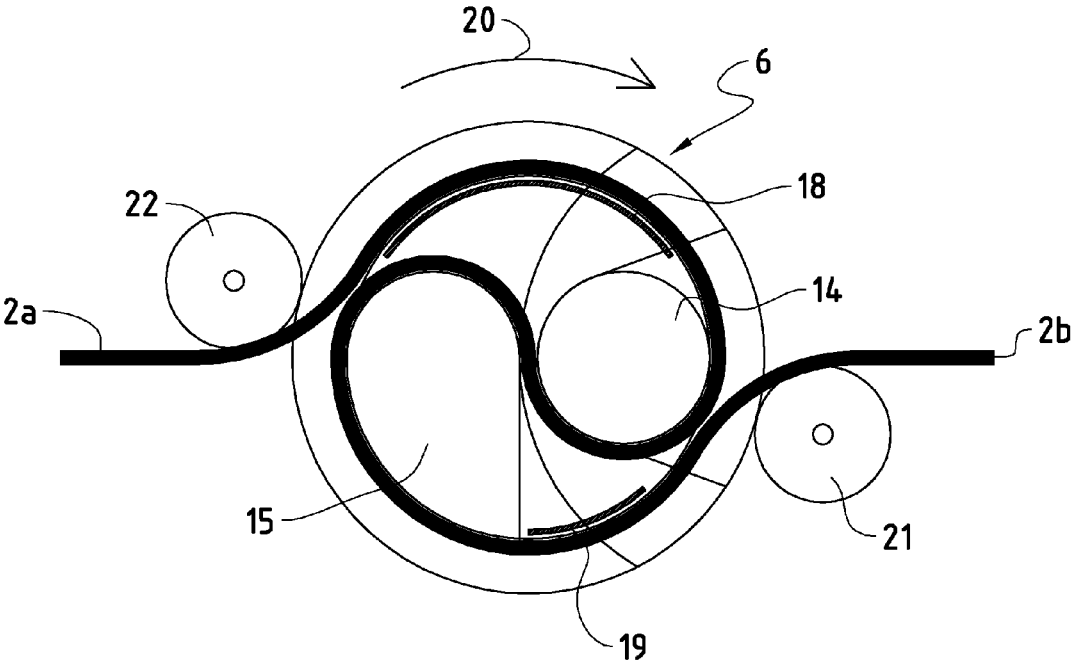

FIGS. 8*a* and 8*b* show the same arrangement as in FIGS. 7*a* and 7*b*, but with more of the tendon portions 2*a* and 2*b* wound on to the reel 6, after the reel has been rotated through 180°. As shown in FIG. 8*a*, height adjustment means is actuated to raise the reel 6 such that the tendon is wound on to the empty surface of the spool 13 instead of being wound over the already wound-on section of tendon 2.

Figure 9A:
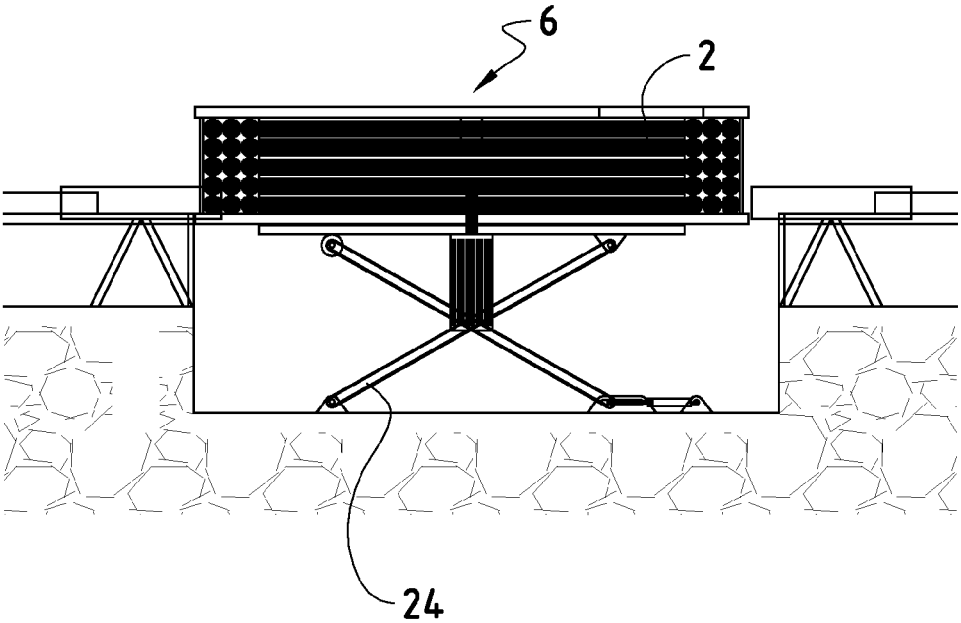
Figure 9B:
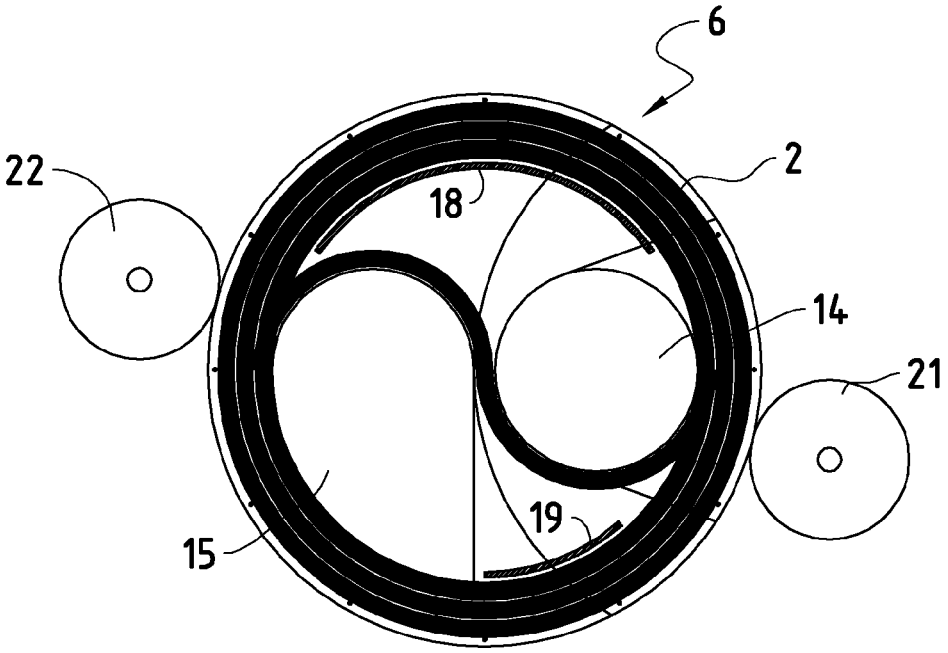
Figure 10A:
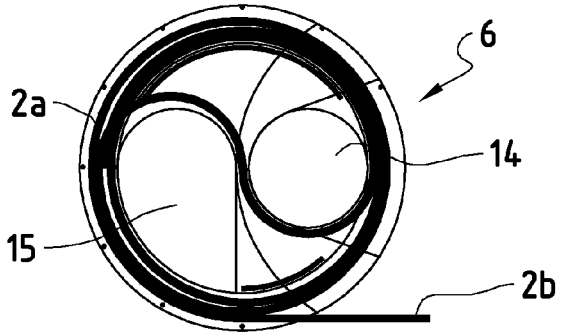
Figure 10B:
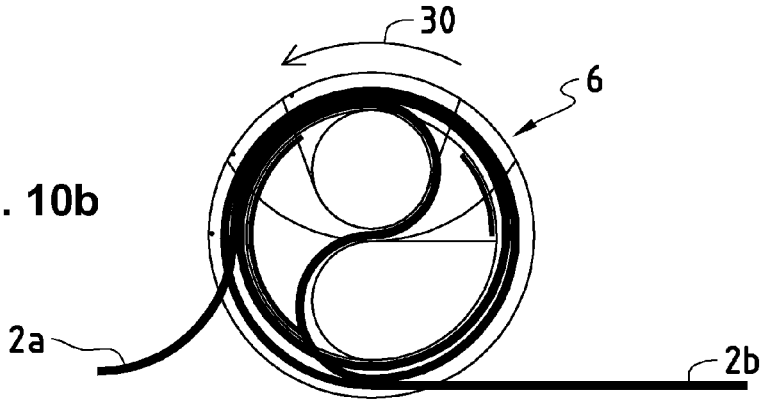
Figure 10C:
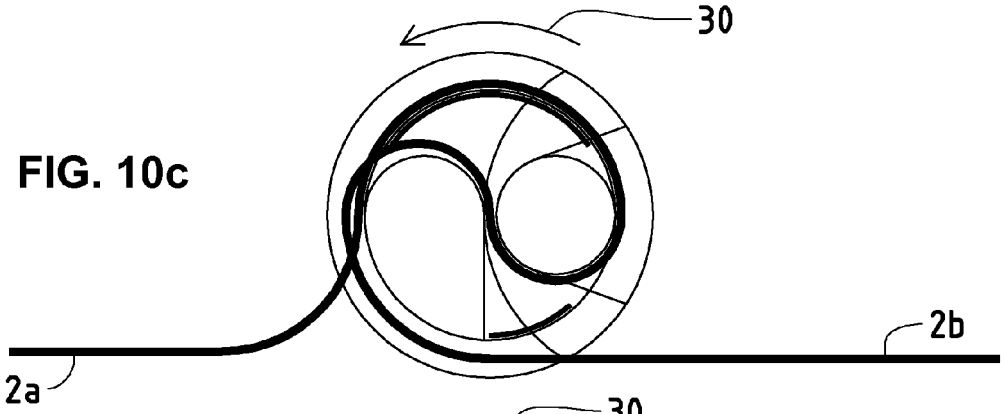
Figure 10D:
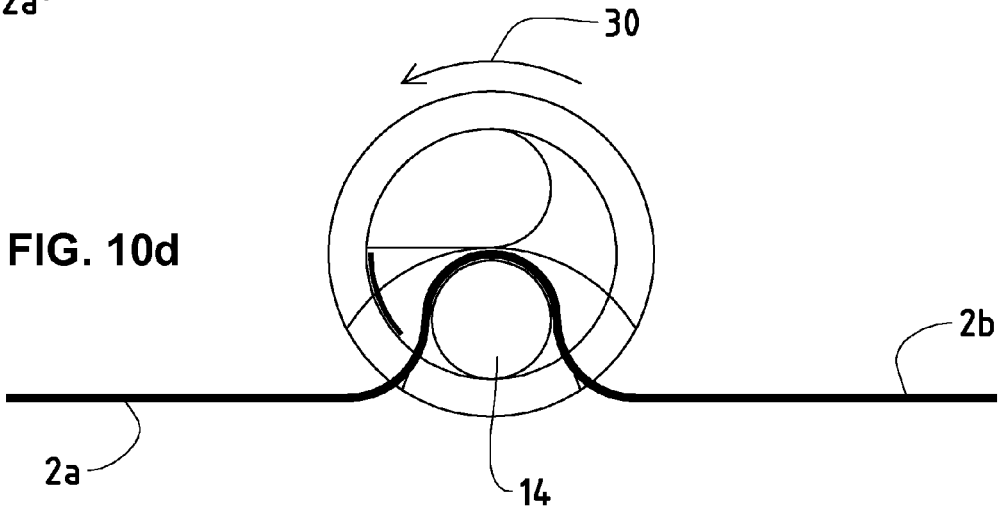

Winding then continues, with the height adjustment means being actuated as required, until all the tendon 6 has been wound on to the reel 6. This situation is shown in FIGS. 9*a* and 9*b*.

FIGS. 10*a* to 10*d* show the unwinding of tendon 2 off the reel 6. Portions 2*a* and 2*b* of tendon 2 are fed off the reel 6 and into the duct portions 4*a* and 4*b* (not shown) respectively. Unwinding continues until all except that mid-portion of the tendon 2 remains on loop retaining element 14. At this point the tendon 2 can be lifted off the loop retaining element 14, and the reel 6 can be removed.

The methods and reel of the present invention can be applied in any tendon-threading situation. However, it is particularly advantageous in tall structures such as that illustrated in FIG. 1. Once a significant proportion of the respective tendon portions 2*a* and 2*b* have been threaded into duct portions 4*a* and 4*b*, the weight of the already-threaded tendon in the duct is enough to pull the remaining tendon into the duct. In this case, braking means can be provided, on the reel mounting, for example, for slowing down the speed of the tendon being pulled into the duct.

While the invention has been described with reference to the threading of PT tendons into PT ducts, the same methods and reel can be used in other situations where long, flexible filaments, such as electrical cables or water pipes, are to be inserted into tubes such as conduits or ducting. The term "tendon" used in this application should therefore be understood to include all such flexible filaments.

The invention claimed is:

1. Method of threading a tendon into a duct, the tendon having an intermediate tendon length portion at a predetermined intermediate location along the length of the tendon between the first and second ends of the tendon, the tendon thereby comprising a first tendon length portion, being the portion of the tendon between the intermediate tendon length portion and the first end of the tendon, and a second tendon length portion, being the portion of the tendon between the intermediate tendon length portion and the second end of the tendon, the duct having an intermediate duct length portion at a predetermined intermediate location along the length of the duct between the first and second ends of the duct, the duct thereby comprising a first duct length portion, being the portion of the duct between the intermediate duct length portion and the first end of the duct, and a second length portion, being the portion of the duct between the intermediate duct length portion and the second end of the duct, the method being characterised by a first step of providing the duct with an opening in the intermediate duct length portion, a second step of feeding the first tendon length portion through the opening into the first duct length portion, and a third step of feeding the second tendon length portion through the opening into the second duct length portion.

2. Method according to claim 1, in which the tendon is a tensioning tendon comprising a plurality of strands, and in which all the strands are threaded through the duct together.

3. Method according to claim 1, in which the second and third steps are performed at least partially simultaneously.

4. Method according to claim 1, in which the second and/or third steps include pushing the tendon length portions into the duct length portions.

5. Method according to claim 1, in which the duct is arranged in a substantially vertical cast structure such that the duct has a first lower end, a second lower end and an upper region between the first and second lower ends, and in which the opening is situated in the upper region of the duct.

6. Method according to claim 1, in which the tendon, the duct and the opening are arranged such that, during at least a part of the second and/or third steps, the tendon is drawn into the duct by the gravitational force on that part of the tendon already fed into the duct.

7. Method according to claim 1, comprising a fourth step, performed before the second and third steps, comprising winding the tendon on to a reel, the winding starting at the intermediate tendon length portion such that the first and second tendon length portions are wound on to the reel simultaneously.

8. Method according to claim 7, in which the second and third steps include:

positioning the reel near to the opening, and unwinding the first and second tendon length portions from the reel and into the opening.

9. Method according to claim 7, wherein the tendon has a winding start portion at a predetermined intermediate location along the length of the tendon between the first and second ends of the tendon, the tendon thereby comprising the first length portion being the portion of the tendon between the winding start portion and the first end of the tendon, and the second length portion being the portion of the tendon between the winding start portion and the second end of the tendon, the tendon having a predetermined minimum radius of bending, hereafter referred to as the bending limit, wherein the reel comprises:

tendon holding means for holding the winding start portion of the tendon such that, when the tendon is wound on to the reel, the winding starts at the winding start portion of the tendon, first winding spool for winding on the first length portion of the tendon, and second winding spool for winding on the second length portion of the tendon; and in which the fourth step of winding the tendon on to the reel includes:

arranging the tendon in position such that the winding start portion engages with the tendon holding means of the reel, winding the first tendon length portion of the tendon on to the first spool of the reel, and winding the second tendon length portion of the tendon on to the second spool of the reel.

10. Method according to claim 9, in which the first and second steps are performed simultaneously.

11. Method according to claim 9, in which the tendon comprises one or more strands, and in which the first step includes arranging each of the strands such that the winding start portion of each strand engages with the tendon holding means of the reel.

12. Method according to claim 9, in which the winding is performed by rotating the or each spool, and in which one or both of the first and second steps comprises moving the respective spool along the axis of rotation of the respective spool in such a way as to control the distribution of tendon coils along the axis of rotation.

* * * * *